US011247096B2

(12) United States Patent
Blessing et al.

(10) Patent No.: US 11,247,096 B2
(45) Date of Patent: Feb. 15, 2022

(54) MOBILITY, MUSCLE, AND COORDINATION DEVELOPMENT APPARATUS

(71) Applicant: MARVEL US BLESSINGS, LLC, Zionsville, IN (US)

(72) Inventors: Ralph Blessing, Downers Grove, IL (US); Andrea L. Marvel, Zionsville, IN (US)

(73) Assignee: Marvel US Blessings, LLC, Zionsville, IN (US)

( * ) Notice: Subject to any disclaimer, the term of this patent is extended or adjusted under 35 U.S.C. 154(b) by 28 days.

(21) Appl. No.: 16/393,691

(22) Filed: Apr. 24, 2019

(65) Prior Publication Data

US 2019/0321679 A1 Oct. 24, 2019

Related U.S. Application Data

(60) Provisional application No. 62/662,001, filed on Apr. 24, 2018.

(51) Int. Cl.

| | |
|---|---|
| ***A63B 21/00*** | (2006.01) |
| ***A61H 3/00*** | (2006.01) |
| ***A47D 13/08*** | (2006.01) |
| ***A63B 23/035*** | (2006.01) |

(52) U.S. Cl.

CPC ..... *A63B 21/4037* (2015.10); *A47D 13/08* (2013.01); *A61H 3/00* (2013.01); *A63B 21/4039* (2015.10); *A63B 23/03575* (2013.01); *A63B 2208/0219* (2013.01); *A63B 2208/12* (2013.01); *A63B 2210/50* (2013.01)

(58) Field of Classification Search

CPC ..... A63B 21/4037; A63B 21/4039; A63B 23/03575; A63B 2208/12; A63B 2210/50; A63B 2208/0219; A61H 3/00; A47D 13/08; A47D 15/001; A47D 13/04

USPC ..... 701/99

See application file for complete search history.

(56) References Cited

U.S. PATENT DOCUMENTS

| | | | | |
|---|---|---|---|---|
| 1,572,273 | A * | 2/1926 | Elton | A47D 13/04 280/87.051 |
| 2,876,459 | A * | 3/1959 | Ackerson | A47D 5/00 4/572.1 |
| 4,413,832 | A * | 11/1983 | Pendleton | A63C 5/00 280/18 |
| 6,019,705 | A * | 2/2000 | Thom | A47D 13/04 482/51 |
| 8,028,361 | B2 * | 10/2011 | Ramer | A63B 21/068 5/655 |
| 8,607,386 | B2 * | 12/2013 | Daly | A47D 15/008 5/655 |

(Continued)

OTHER PUBLICATIONS

Amazon Airhead Frost Rocket 2 Person Foam Toboggan Snow Sled Apr. 27, 2017 "https://www.amazon.com/dp/B01N2GUR6J/ref=sspa_dk_detail_1?psc=1&pd_rd_i=B01N2GUR6J&pd_rd_w=6QANQ&pf_rd_p=54ed5474-54a8-4c7f-a88a-45f748d18166&pd_rd_wg=dl7LI&pf_rd_r=Y475EM064GTEQ6READ44&pd_rd_r=3a0ab04f-36d7-4170-9379-d908caa30884&spLa=ZW5jcnlwdGVkUXVhbGlmaWVyPUExNIRHRFpXTERDUjRHJmVuY3J5cHRIZEIkPUEwMjgxMDM3MIVTM0RIUIIWM0Q2USZIbmNyeXB0ZWRBZEIkPUEwMzY0NDkyTk1URzFUOFJTNDRDJndpZGdldE5hbWU9c3BfZGV0YWIsX3RoZW1hdGljJmFjdGlvbj1jbGlja1JIZGIyZWN0JmRvTm90TG9nQ2xpY2s9dHJ1ZQ==" (Year: 2017).*

*Primary Examiner* — Nyca T Nguyen

(74) *Attorney, Agent, or Firm* — McDonnell Boehnen Hulbert & Berghoff LLP

(57) ABSTRACT

An apparatus for improving mobility and helping develop back, neck, arm, core and leg muscle strength and coordination is provided. The apparatus may include a body portion comprising a first layer and a second layer and be (Continued)

configured to slide on a floor surface. A method for improving mobility of a user is also provided.

15 Claims, 10 Drawing Sheets

(56) References Cited

U.S. PATENT DOCUMENTS 9,468,799 B1 * 10/2016 Ware ..... A63B 23/0482
9,693,637 B1 * 7/2017 Kanzler ..... A47D 13/04
D800,480 S * 10/2017 Paperno ..... A47D 13/08 D6/596
2002/0133881 A1 * 9/2002 Vrbas ..... A47D 15/008 5/655
2004/0132594 A1 * 7/2004 Verna ..... A63B 21/4039 482/140
2005/0248110 A1 * 11/2005 Stouffer ..... A61G 1/0237 280/87.021
2005/0278854 A1 * 12/2005 Taricani ..... A47D 13/08 5/655
2006/0096031 A1 * 5/2006 Foster ..... A47D 15/008 5/655
2008/0092300 A1 * 4/2008 Joe ..... A47D 15/008 5/655
2008/0176725 A1 * 7/2008 Mehendale ..... A63B 26/00 482/142
2009/0151080 A1 * 6/2009 Lord ..... A47D 13/08 5/655
2011/0265264 A1 * 11/2011 Reeder, Jr. ..... A47D 15/008 5/640
2012/0004083 A1 * 1/2012 Cuba ..... A63B 23/0233 482/142
2012/0190516 A1 * 7/2012 Geotsalitis ..... A63B 22/20 482/142
2013/0144475 A1 * 6/2013 Pidcoe ..... A47D 13/04 701/22
2013/0198953 A1 * 8/2013 Long ..... A63B 21/4037 5/417
2015/0190668 A1 * 7/2015 Ferdinandsen, II . A63B 21/012 482/93
2016/0166083 A1 * 6/2016 Carbone ..... A47D 1/08 5/655
2017/0056745 A1 * 3/2017 Stacey ..... A63B 21/0084
2017/0095096 A1 * 4/2017 Mandell ..... A47G 9/10
2017/0202367 A1 * 7/2017 Barbu-Roth ..... A47D 13/08

* cited by examiner

MOBILITY, MUSCLE, AND COORDINATION DEVELOPMENT APPARATUS

CROSS-REFERENCE TO RELATED APPLICATIONS

This application claims the benefit of priority of U.S. Provisional Patent Application No. 62/662,001, filed Apr. 24, 2018, which is incorporated by reference in their entirety.

FIELD OF THE DISCLOSURE

The present disclosure relates to apparatuses to enhance a user's mobility, muscle, and coordination development, for example, for a baby during "tummy time" and the pre-crawling, creeping stage of development. The apparatus can also be used for back, neck, arm, core and leg muscle development in older kids, adults, and those with certain handicaps (e.g., a paraplegic) or physical therapy needs.

BACKGROUND

Since the early 1990's parents and caregivers have been encouraged to place children on their backs to sleep. This change of positioning while sleeping has resulted in the reduction of SIDS (Sudden Infant Death Syndrome) by more than 50%. While this change in positioning has greatly reduced the number of infant deaths, it has created another issue for children, which is the reduction of strength in the neck, back, and arm muscles. In addition, the baby's head may develop flat spots (positional plagiocephaly) from the amount of time on their back.

Due to this, pediatricians recommend adding "tummy time" to an infant's day for up to thirty minutes or more in order to strengthen the neck, back, shoulder, and arm muscles. The development of these muscles, as well as coordination skills, is critical to a child's future development, as coordination skills along with the arms, neck, and back muscles are utilized during the crawling phase.

Many babies do not like tummy time and cry and fuss while on their tummies and consequently the amount of time on the tummy is less than what is optimal for their development. Further, once babies have the strength to begin moving their arms and legs in a pre-crawling or creeping phase, they further become frustrated because they are stuck and unable to move. Some parents report that their child "never learned to crawl" or "rolled everywhere" missing the crawling phase altogether. Learning to crawl is an important milestone in a child's development. Crawling increases a child's gross motor and fine motor skills. Crawling increases a child's hand-eye coordination and balance. Additionally, children that learn to crawl have better spatial understanding and binocular vision. Crawling also improves coordination, self-confidence and physical strength. Some studies indicate that children that miss the crawling phase all together have shorter attention spans; have a harder time sitting still in a chair and have more difficulty learning to write.

Thus, there is a need for a developmental apparatus to enhance a child's ability to be mobile (i.e., mobility) during the pre-crawling or creeping stage of development and to make tummy time more fun and more active for the baby. There is also a need for a larger apparatus to assist with development of back, neck, arm, core and leg muscles of older kids, adults, and those with certain handicaps or physical therapy needs.

SUMMARY OF THE DISCLOSURE

The features, functions, and advantages can be achieved independently in various embodiments of the present disclosure or may be combined in yet other embodiments in which further details can be seen with reference to the following description and drawings.

Described herein is an apparatus that is capable of non-motorized, multidirectional movement for improving mobility in the user.

In one embodiment, an apparatus for improving mobility and helping develop back, neck, arm, core and leg muscle strength and coordination of a user is provided. The apparatus includes a body portion comprising a first layer (e.g., a plastic shell) and a second layer (e.g., fabric covered foam) with a hook and loop attachment or some other way of attaching the two layers. The apparatus is the first available configured to slide and rotate in any direction on a flat floor surface (e.g., carpet or hardwood/or tile or other floor covering).

In another embodiment, an apparatus for improving mobility of a user is provided. The apparatus includes a concave body with a first layer and a second layer and at least one protruding portion. The first layer is a soft/cushioned upper surface and the second layer is a hard lower surface. The at least one protruding portion slopes upward to better support the baby's head and help prevent injury if the head flops down. The apparatus is configured to slide on a floor surface.

In another embodiment, a method for improving mobility of a user is provided. The method includes positioning the user on the body portion of a mobility apparatus and moving the apparatus on the floor surface.

BRIEF DESCRIPTION OF THE FIGURES

The above, as well as additional, features will be better understood through the following illustrative and non-limiting detailed description of example embodiments, with reference to the appended drawings.

All the figures are schematic, not necessarily to scale, and generally only show parts which are necessary to elucidate example embodiments, wherein other parts may be omitted or merely suggested.

DETAILED DESCRIPTION

Example embodiments will now be described more fully hereinafter with reference to the accompanying drawings.

That which is encompassed by the claims may, however, be embodied in many different forms and should not be construed as limited to the embodiments set forth herein; rather, these embodiments are provided by way of example. Furthermore, like numbers refer to the same or similar elements or components throughout.

Figure 1A:
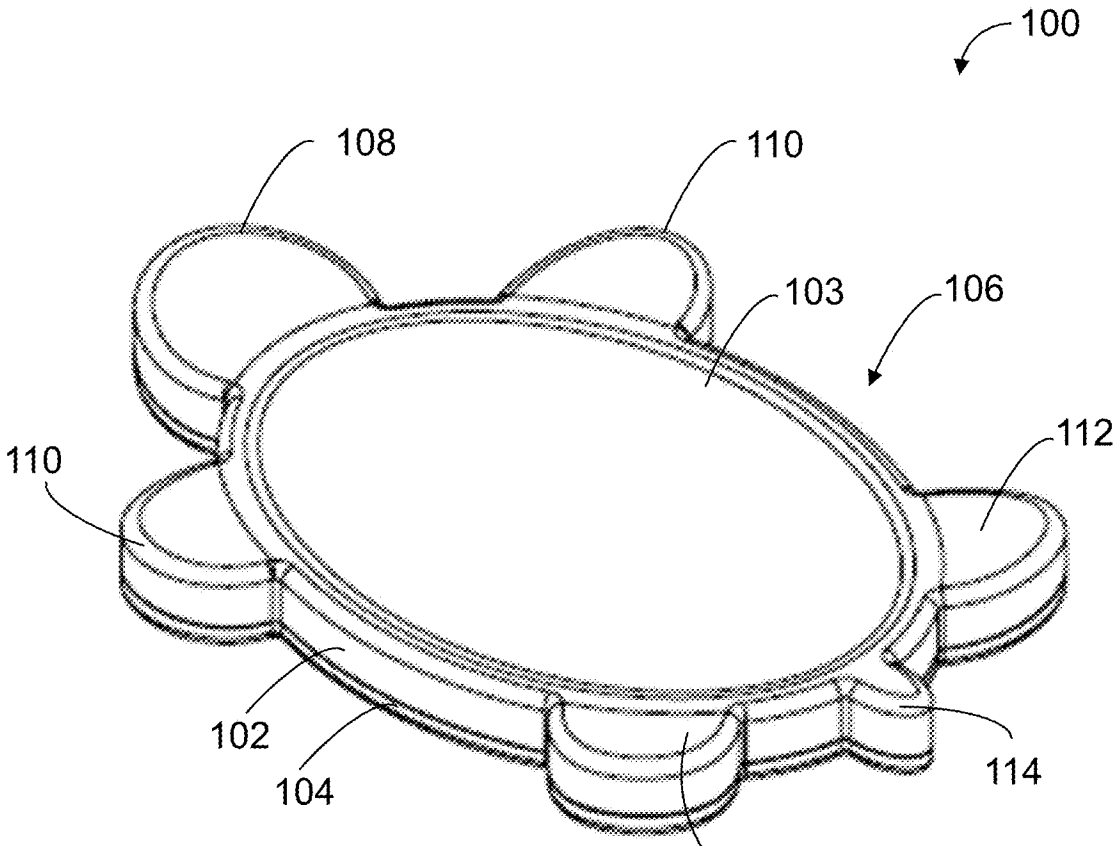
FIG. 1*a* illustrates a perspective view of an apparatus according to an example embodiment.
Figure 4A:
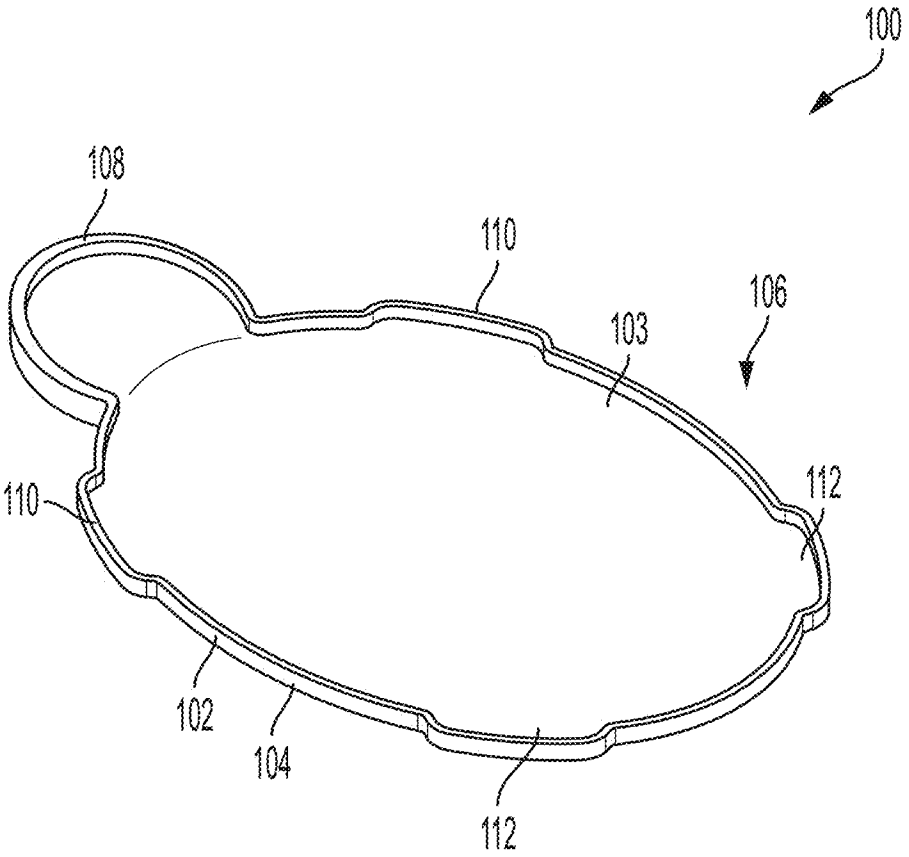
FIG. 4*a* illustrates a perspective view of an apparatus according to an example embodiment.
Figure 4B:
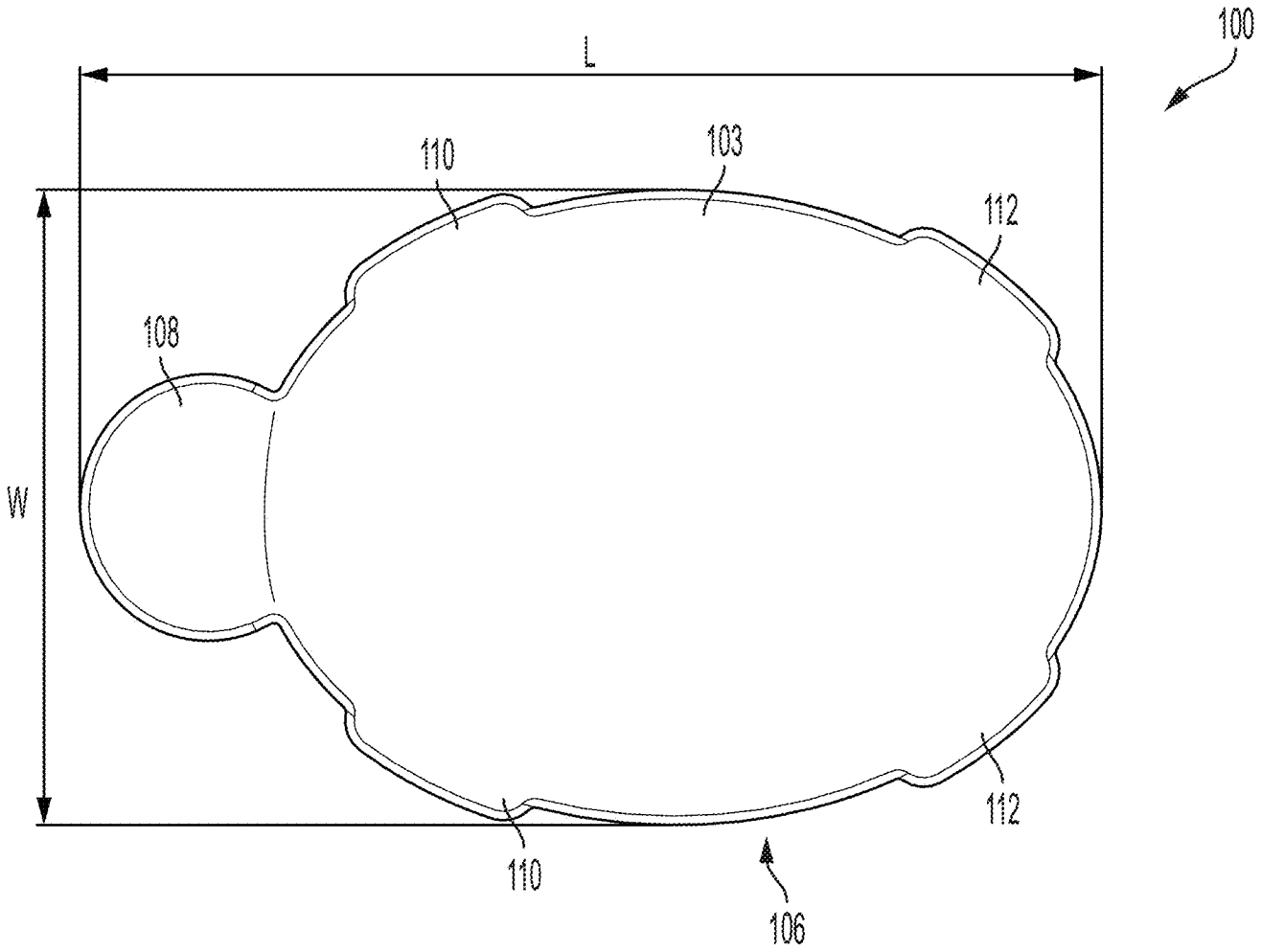
FIG. 4*b* illustrates a top view of the apparatus of FIG. 4*a* according to an example embodiment.

Reference is first made to FIG. 1*a* and FIG. 4*a*, a perspective view of a mobility apparatus 100. The apparatus 100 may be of any shape. The apparatus 100 may include a body portion 106. The apparatus 100 may also include at least one protruding portion that is connected to the body portion. In some embodiments, the at least one protruding portion may be co-molded with the body portion 106 such that it is an integral part of and is not removable. In other embodiments, the at least one protruding portion 108 may be formed separately from the body portion 106, allowing for the protruding portion 108 to then be removable from the body portion 106. The body portion 106 may be slightly concave in order to fit a user's stomach and properly cradle the user, thus providing stability for the user during use. In some embodiments, body portion 106 may be generally concave shaped and contoured to support portions of the user's body, such as the abdomen and chest, of an infant between three months and six months of age. The at least one protruding portion may also configured to receive the user's head, of an infant between three months and nine months of age. The at least one protruding portion may also be slightly concave in order to fit a user's head, arms, and/or legs, of an infant between three months and nine months of age. The at least one protruding portion 108 may also slope upward slightly in order to make movement and spinning easier.

The apparatus 100 may comprise at least a first layer 102 and a second layer 104 of the body portion 106. The first layer 102 may be a deformable foam or gel layer to cushion the person using the apparatus 100. The first layer may be an upper surface of the body 106 and may comprise a memory-foam like material to conform to the body of the user. The second layer 104 may be a hard, smooth material and configured to slide easily on a floor surface, for example, carpet or hard wood floors. The second layer 102 may be a lower surface of the body 106. The first layer 102 may be thicker than second layer 104.

A cover 103 may cover the first layer 102. The cover 103 may be removable and machine washable. In other embodiments, the cover 103 may be sewn around the first layer 102. In some embodiments, the cover 103 may comprise polyester or other fabric. In an example embodiment, the cover 103 may surround the first layer 102 like a slipcover or a pillowcase, such that the cover 103 can be removed and washed or replaced. In some embodiments, the cover 103 may be attached to the first layer 102 with a hook and loop fastener.

Materials used for the apparatus 100 need to be approved by the government for use by children and need to be subjected to safety testing. The materials should be non-toxic if licked, chewed, or ingested. The materials may also be hypoallergenic so as to not irritate the skin of the user. For example, the first layer 102 may comprise solid open-cellular foam, such as polyurethane foam with a density of between about 0.01 g/cm$^3$ and 0.1 g/cm$^3$. Other foams known in the art may also be used. The second layer 104 may comprise a thermoplastic, for example, an ethylene-hexene copolymer such as high density polyethylene with a density of about 0.95 g/cm$^3$. Other polymers known in the art may also be used. All of the materials may be washable and/or water repellant.

Figure 1B:
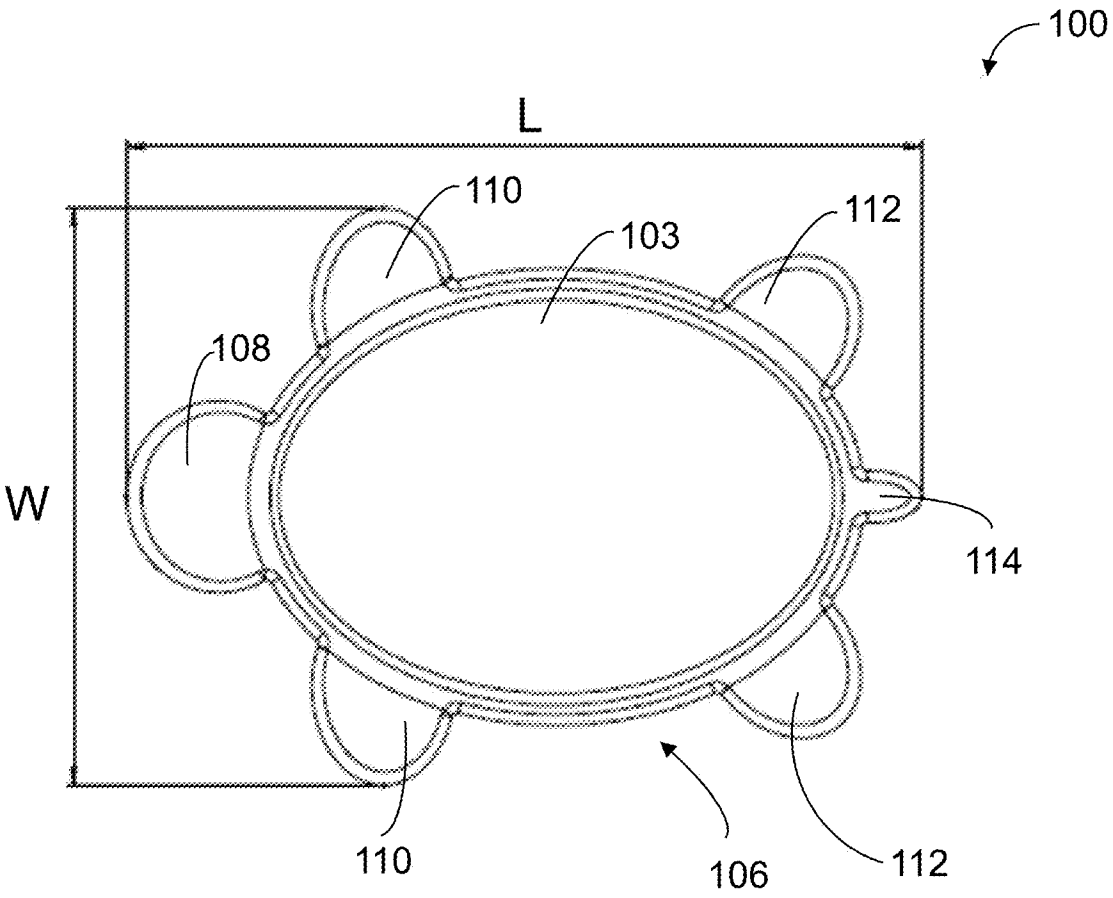
FIG. 1*b* illustrates a top view of the apparatus of FIG. 1*a* according to an example embodiment.

In an example embodiment, the first layer 102 and the second layer 104 may be attached with at least one hook and loop fastener. In some embodiments, more than one hook and loop fasteners or other types of fasteners may be used. In an example embodiment, the fabric cover for the first layer may include at least a first hook and loop fastener portion (not shown) and the second layer 104 may include at least a second hook and loop fastener portion 116, as illustrated in FIG. 1*f*. In other embodiments, the first layer 102 and the second layer 104 may be glued together or attached by welding with heat or pressure. In such embodiments, a removable and washable cover may be placed over the first layer 102 after it is attached to the second layer 104 and secured with elastic.

In an example embodiment, the apparatus 100 may be the shape of a turtle, as shown in FIG. 1*a*. In this embodiment, apparatus 100 may include a body portion 106 and a plurality of protruding portions. The plurality of protruding portions may include a head 108, two arms 110, two legs 112, and a tail 114. In example embodiments, the head 108, the arms 110, and the legs 112 may slope upward slightly in order to make movement and spinning easier. FIG. 1*e* shows a cross-section of apparatus 100, which illustrates how the head 108, the arms 110, and the legs 112 slope upward. FIG. 1*e* also shows how the body 106 is slightly concave in order to fit a user's stomach and properly cradle the user, so that the user does not fall off of the apparatus during use (see indentation 116), thus providing stability. The head 108, arms 110, and legs 112 may also be slightly concave in order to fit the baby's head, arms, and legs.

Figure 2:
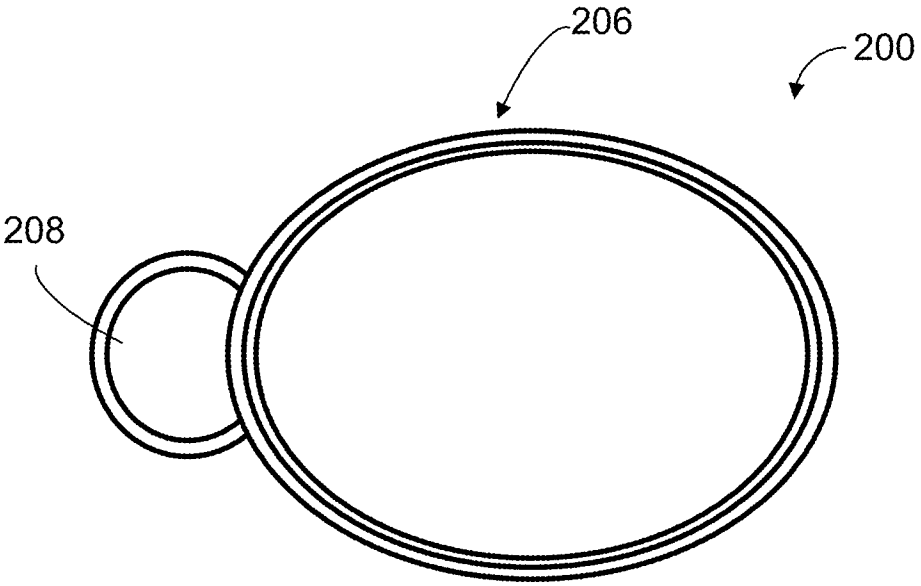
FIG. 2 illustrates a top view of an apparatus according to an example embodiment.
Figure 3:
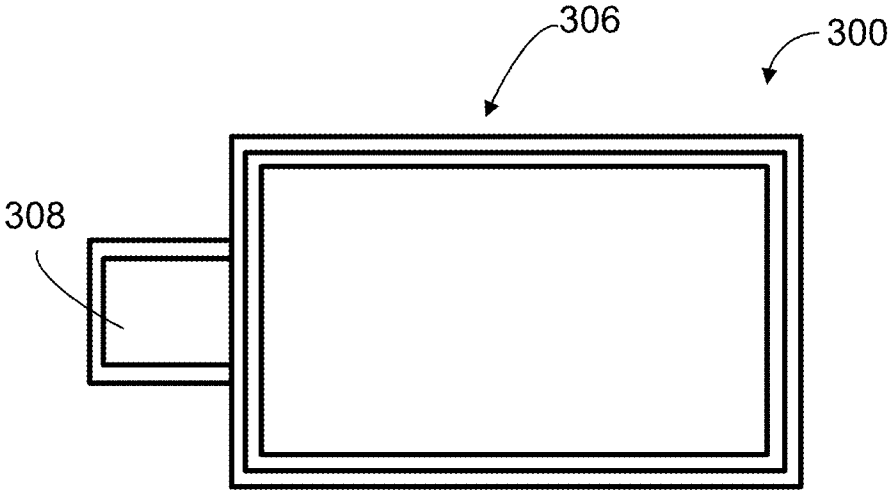
FIG. 3 illustrates a top view of an apparatus according to an example embodiment.

In other embodiments, the apparatus may be an oval-shaped apparatus 200, as shown in FIG. 2. In an example embodiment, the oval shaped apparatus 200 may comprise an oval-shaped body portion 206 and an oval-shaped protruding portion 208. In another embodiment, the apparatus may be or a rectangular-shaped apparatus 300, as shown in FIG. 3. The rectangular-shaped apparatus 300 may comprise a rectangular-shaped body portion 306 and a rectangular-shaped protruding portion 308. In other embodiments, the mobility apparatus may be of any shape that allows a user to increase mobility and provide stability for the user. The body portion and the protruding portions may also be of any shape that allows for support of body parts and provide stability. In other embodiments, the apparatus may comprise more than two layers.

The mobility apparatus may be of any size needed. For example, it may be sized to fit a baby or small child. In other embodiments, it may be sized to fit a larger child or an adult. As shown in FIG. 1*b*, the apparatus 100 may be of a length L and a width W. The length L may be larger than the width W. For example, the length L may be about 1.4 times the width W. In an example embodiment, the length L may be about 12 inches and the width W may be about 8.7 inches. In other examples, such as for adult users, the length L may be about 3 times the width W. In an example embodiment for an adult user, the length L may be about 36 inches and the width W may be about 12-14 inches.

Figure 1C:
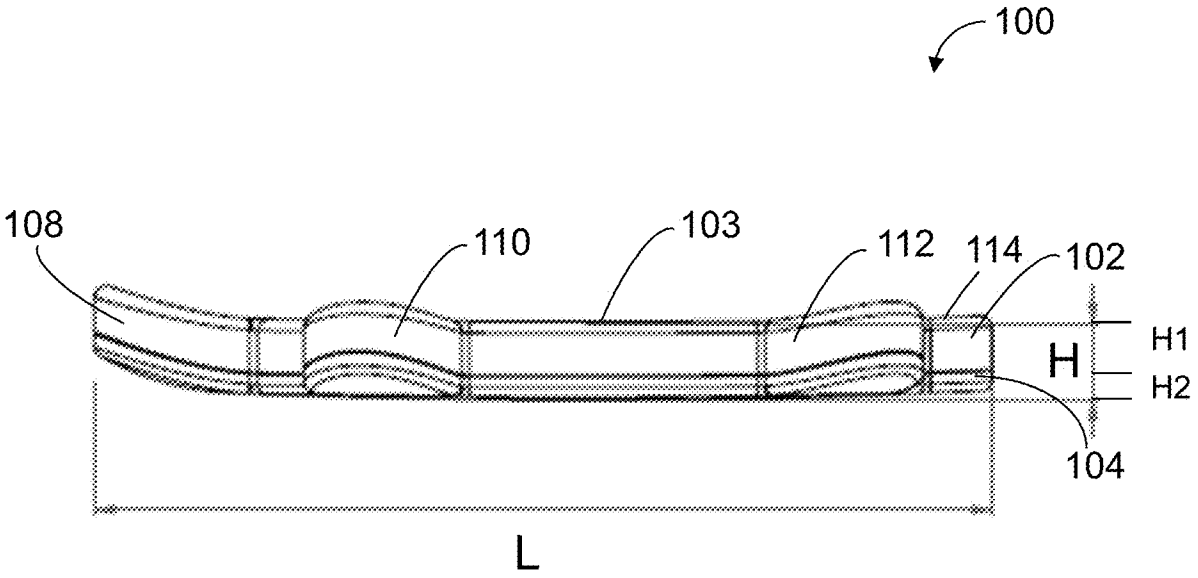
FIG. 1*c* illustrates a side view of an apparatus of FIG. 1*a* according to an example embodiment.
Figure 1D:
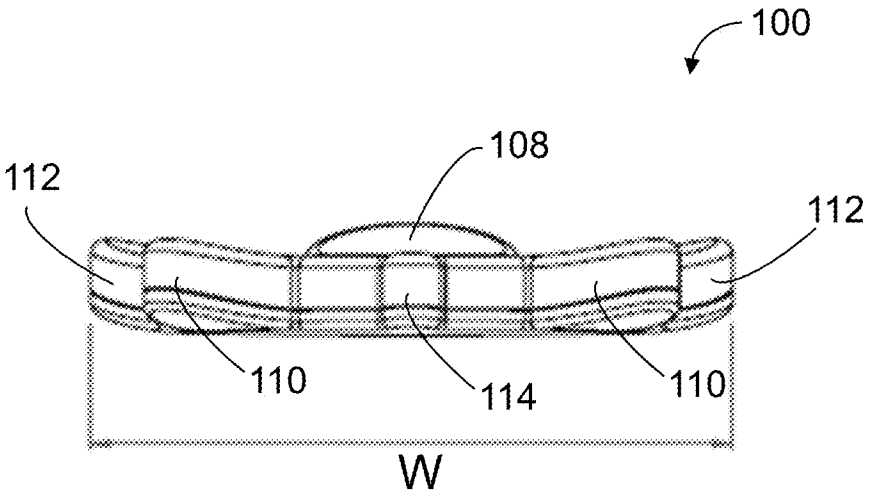
FIG. 1*d* illustrates a rear view of an apparatus of FIG. 1*a* according to an example embodiment.
Figure 1E:
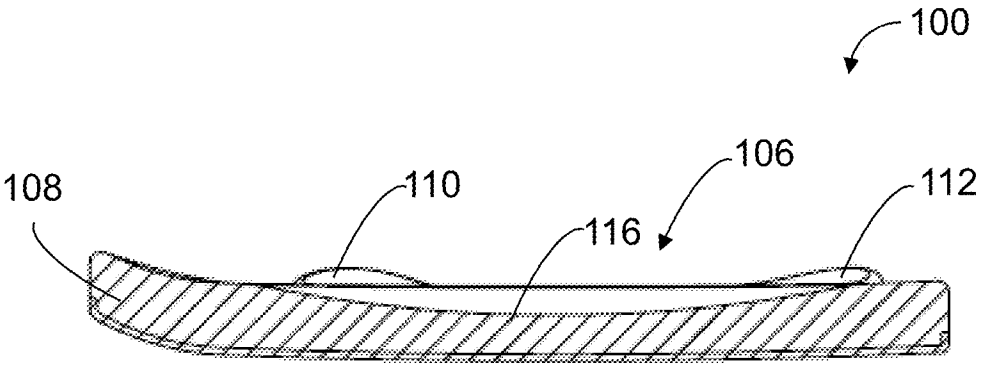
FIG. 1*e* illustrates a cross-sectional view of an apparatus of FIG. 1*a* according to an example embodiment.
Figure 1F:
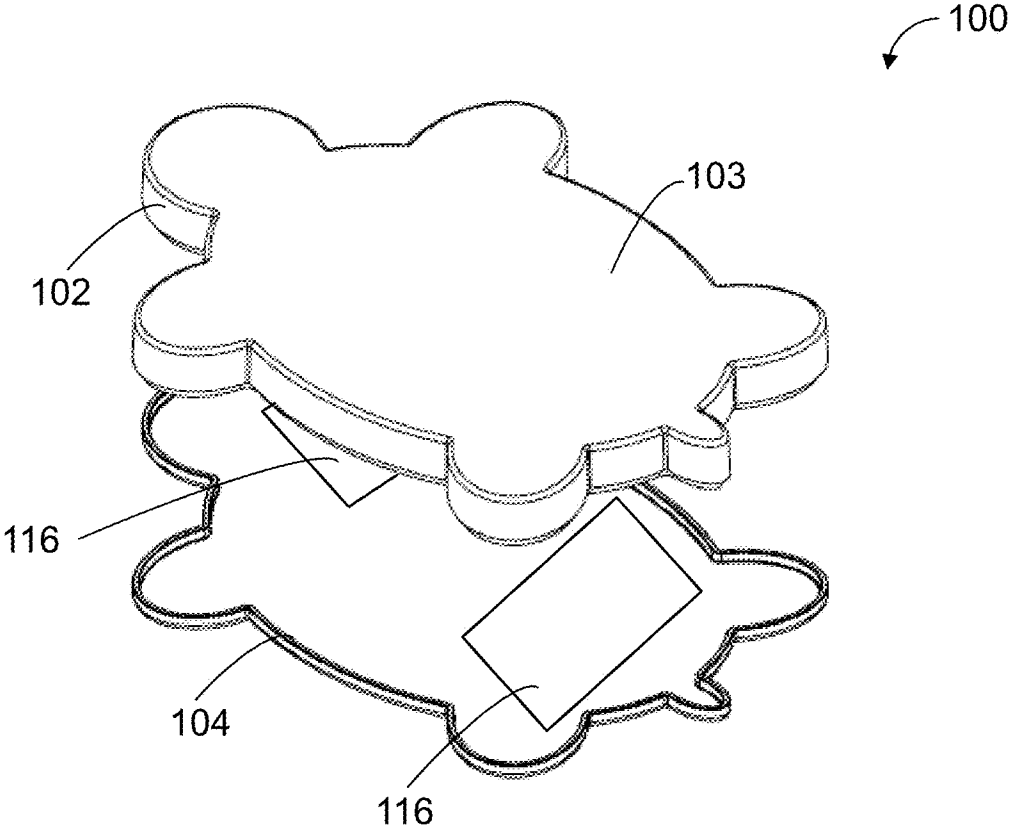
FIG. 1*f* illustrates an exploded view of an apparatus according to an example embodiment.

As shown in FIG. 1*c*, the apparatus may also be of height H. In an example embodiment, the height may be about a minimum of about 0.75 inch. Lower heights may be used for infant applications, in order to keep the infant closer to the floor for safety. In other embodiments, such as for non-infants, the height may be higher, for example, about 0.75 inch to about 1.5 inches. The first layer 102 may have a height H1 and the second layer 104 may have a height H2. The height H1 may be equal to or greater than the height H2. In an example embodiment, the height H1 may be about 2 times the height H2. For example, the height H1 may be about 0.50 inch and the height H2 may be about 0.25 inch. In other embodiments, the height H1 may be between about 0.4 and 0.6 inches and the height H2 may be between about 0.20 inches and about 0.30 inches. In other embodiments, the height H1 may be approximately the same as the height H2. For example, the height H1 may be about 0.25 inch and the height H2 may be about 0.25 inch.

The present disclosure also provides a method for improving mobility of a user. The method may include positioning the user on the body portion of the apparatus shown in any of FIG. 1*a*-1*f*, 2, or 3 and moving the apparatus on the floor surface.

In operation, a user uses the mobility apparatus to assist that user in moving around, developing core, neck, back, leg and arm muscle strength and developing coordination. The user's stomach is placed on the body portion of the apparatus and the user's head is placed on the protruding portion of the apparatus. In certain examples, the user is able to slide in a multidirectional manner on a floor surface including carpet, hardwood, tile or other floor covering.

While some embodiments have been illustrated and described in detail in the appended drawings and the foregoing description, such illustration and description are to be considered illustrative and not restrictive. Other variations to the disclosed embodiments can be understood and effected in practicing the claims, from a study of the drawings, the disclosure, and the appended claims. The mere fact that certain measures or features are recited in mutually different dependent claims does not indicate that a combination of these measures or features cannot be used. Any reference signs in the claims should not be construed as limiting the scope.

What is claimed is:

1. An apparatus for improving mobility of a user, the apparatus comprising:

(i) a body portion comprising a first layer removably attached to a second layer; wherein the first layer comprises a deformable material and the second layer comprises a polymer; and (ii) a plurality of protruding portions extending from the second layer, wherein the plurality of protruding portions are in the form of a head, arms, and legs;

wherein the plurality of protruding portions slope upward; and wherein substantially an entirety of a bottom surface of the second layer is configured to be in direct contact with, generally parallel to, and slide multi-directly on a floor surface; and wherein the apparatus is configured to support a body of a user.

2. The apparatus of claim 1, wherein the plurality of protruding portions is configured to receive the user's head.

3. The apparatus of claim 1, wherein the plurality of protruding portions are an integral part of the body portion.

4. The apparatus of claim 1, wherein the plurality of protruding portions are detachable from the body portion.

5. The apparatus of claim 1, wherein the body portion of the apparatus is oval shaped.

6. The apparatus of claim 1, wherein the body portion of the apparatus is rectangular shaped.

7. The apparatus of claim 1, wherein the first layer comprises a polymeric foam.

8. The apparatus of claim 1, wherein the first layer comprises a polyurethane foam.

9. The apparatus of claim 1, wherein the second layer comprises a thermoplastic.

10. The apparatus of claim 1, further comprising a cover.

11. The apparatus of claim 1, wherein the plurality of protruding portions are concave.

12. A method for improving mobility of the user, comprising:

positioning the user on the body portion of the apparatus of claim 1; and moving the apparatus on the floor surface.

13. An apparatus for improving mobility of a user, the apparatus comprising:

(i) a substantially planar body portion with a first layer removably attached to a second layer, wherein the first layer is a soft upper surface and is deformable, wherein the second layer is a hard lower surface; and (ii) a plurality of protruding portions extending from the second layer, wherein the plurality of protruding portions slope upward, wherein a bottom surface of the second layer of the substantially planar body portion is configured to be substantially parallel to and slide directly on a floor surface, and wherein the plurality of protruding portions are in the form of a head, arms, and legs.

14. The apparatus of claim 13, wherein the apparatus is of a length L and of a width W, and wherein the length L is about 1.4 times the width W.

15. The apparatus of claim 13, wherein the first layer is of a height H1 and the second layer is of a height H2, and wherein the height H1 is greater than the height H2.

* * * * *